US006328288B1

(12) United States Patent
Gerhardy

(10) Patent No.: US 6,328,288 B1
(45) Date of Patent: Dec. 11, 2001

(54) DIAPHRAGM-TYPE CARBURETOR FOR A TWO-CYCLE ENGINE THAT OPERATES WITH LAYERED SCAVENGING

(75) Inventor: Reinhard Gerhardy, Korb (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/557,083

(22) Filed: Apr. 21, 2000

(30) Foreign Application Priority Data

Apr. 24, 1999 (DE) ..... 199 18 719

(51) Int. Cl.[7] ..... F02M 17/04
(52) U.S. Cl. ..... 261/35; 261/DIG. 1; 261/DIG. 68
(58) Field of Search ..... 261/16, 35, 69.1, 261/69.2, DIG. 1, DIG. 68

(56) References Cited

U.S. PATENT DOCUMENTS 2,981,279 * 4/1961 Beck ..... 261/DIG. 1
4,861,522 * 8/1989 Gerhardy et al. ..... 261/DIG. 68
4,903,655 * 2/1990 Vonderau et al. ..... 261/35 X
4,936,267 * 6/1990 Gerhardy et al. ..... 261/35 X
4,944,272 * 7/1990 Carlsson et al. ..... 261/DIG. 68
5,283,013 * 2/1994 Gerhardy ..... 261/35
5,681,508 * 10/1997 Gerhardy ..... 261/35
5,743,240 * 4/1998 Zerrer et al. ..... 261/DIG. 68
6,123,322 * 9/2000 Sasaki ..... 261/69.1 X

* cited by examiner

*Primary Examiner*—Richard L. Chiesa
(74) *Attorney, Agent, or Firm*—R. W. Becker & Associates; R. W. Becker

(57) ABSTRACT

A diaphragm-type carburetor is provided for a two-cycle engine, in a manually guided implement, that operates with layered scavenging. Formed in the carburetor housing is an intake channel portion in which is disposed a butterfly valve that is pivotably held by a shaft. Opening into the intake channel portion are fuel-conveying channels supplied from a fuel-filled control chamber that is formed on a longitudinal side of the intake channel portion in the carburetor housing and is separated from a compensation chamber by a diaphragm. Air for combustion is additionally supplied to the engine via an air channel formed in a functional component of the carburetor fixed on the housing thereof on a longitudinal side of the intake channel portion. The air channel is disposed approximately parallel to the intake channel portion and is guided from that end face of the carburetor that faces an air filter to the connecting side of the carburetor that faces the internal combustion engine. Disposed in the air channel is a throttle member that is rotatably held by a shaft, which is coupled together with the shaft of the butterfly valve by means of a transmission connection.

12 Claims, 3 Drawing Sheets

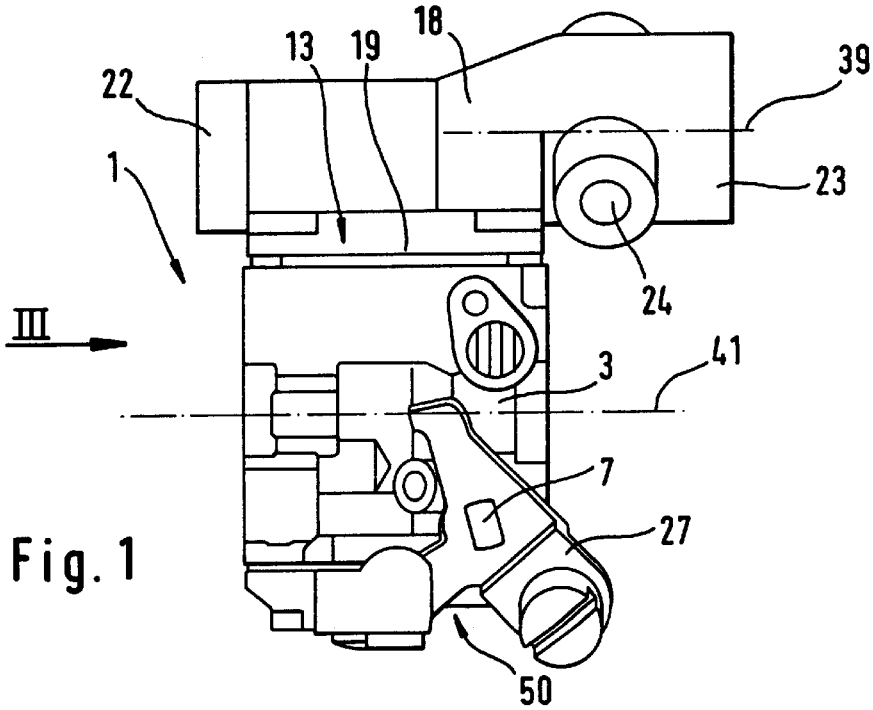
Fig. 1
Fig. 2
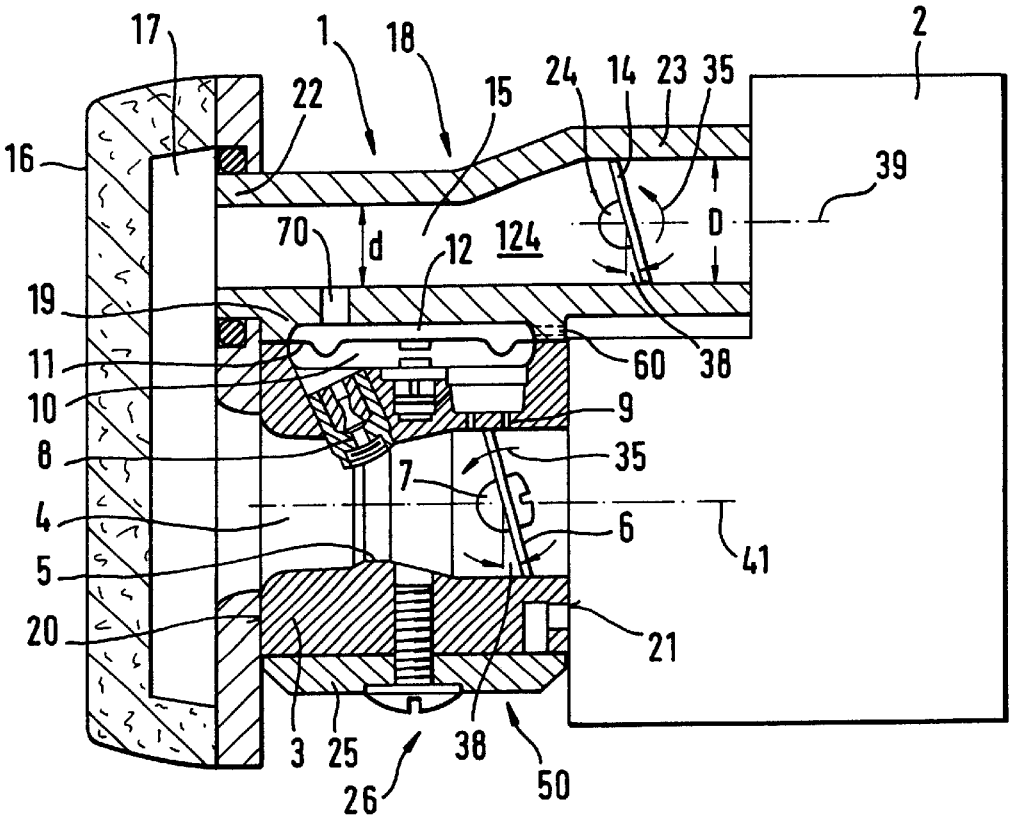

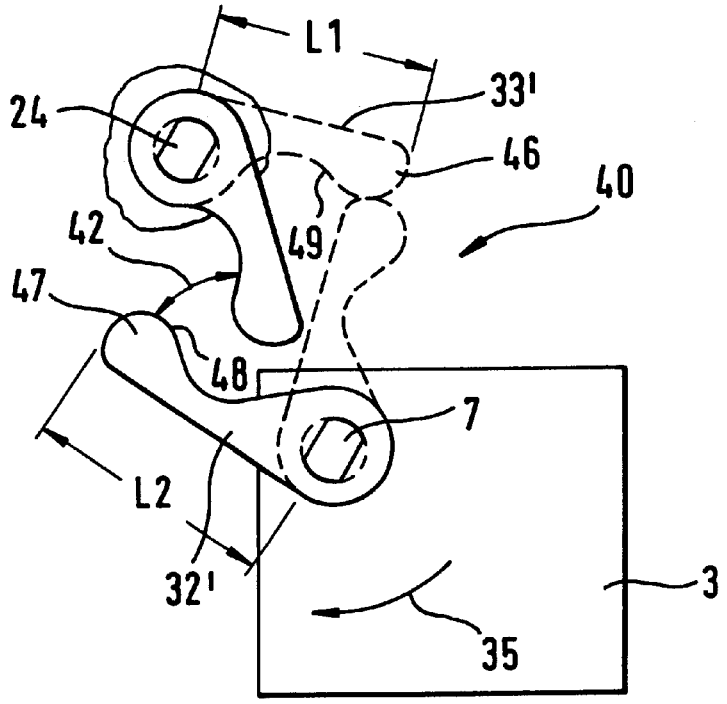
Fig. 5
Fig. 6
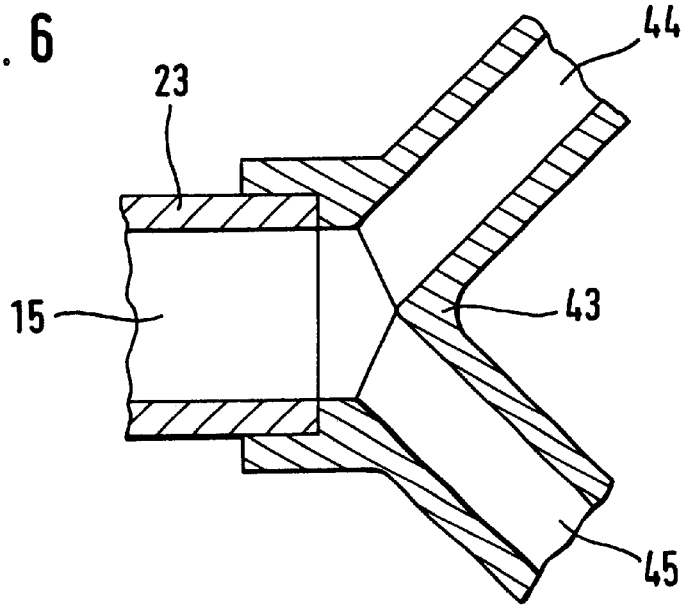

DIAPHRAGM-TYPE CARBURETOR FOR A TWO-CYCLE ENGINE THAT OPERATES WITH LAYERED SCAVENGING

BACKGROUND OF THE INVENTION

The present invention relates to a diaphragm-type carburetor for an internal combustion engine that operates with layered scavenging, especially for the two-cycle engine in a manually guided implement, such as a power chainsaw, a cut-off machine, a brush cutter, or the like. Formed in the carburetor housing is an intake channel portion in which is disposed the butterfly valve that is pivotably held by a shaft and in the vicinity of which fuel-conveying channels open into the intake channel portion. Such fuel-conveying channels are supplied from a fuel-filled control chamber that is formed on a longitudinal side of the intake channel portion of the carburetor housing and is separated from a compensation chamber by a control diaphragm. An air channel that additionally supplies air for combustion is formed in a component secured to the carburetor housing and has a throttle member that is rotatably held by a shaft and that is adjustable by being coupled with the position of the butterfly valve.

A carburetor of this general type is known from the Japanese publication JP 09268917 A. Disposed between the air filter and the carburetor housing is an intermediate piece that extends the intake channel portion and from which branches a connecting line that opens into the transfer port between crank case and combustion chamber of the connected two-cycle engine. During operation of the internal combustion engine, fuel-air mixture is drawn into the crank case via the carburetor, while via the connecting line into the transfer ports adjacent to their inlet openings fuel-free air for combustion is drawn into the combustion chamber. Therefore, when the transfer ports are opened, first combustion air by itself that was previously collected in the transfer ports flows into the combustion chamber and displaces the exhaust gases found therein to the exhaust valve. The fuel-free air for combustion follows the fuel/air mixture that flows out of the crank case into the combustion chamber. Such a layered scavenging lowers the scavenging losses that are unavoidable with two-cycle engines. Unfortunately, arranging an intermediate flange between the air filter and the carburetor for branching off the air for combustion by itself leads to a lengthening of the overall length, which creates problems where the space conditions are limited. Especially for portable, manually guided implements, the installation space provided for accommodating the carburetor and the air filter is very limited, for which reason the conversion of the layered scavenging is particularly problematic for such applications.

It is an object of the present invention to provide a diaphragm-type carburetor for an internal combustion engine that operates with layered scavenging, which such a carburetor having a short overall length while maintaining a small overall size.

BRIEF DESCRIPTION OF THE DRAWINGS

This object, and other objects and advantages of the present invention, will appear more clearly from the following specification in conjunction with the accompanying schematic drawings, in which:

FIG. 1 is a view of one exemplary embodiment of an inventive diaphragm-type carburetor;

FIG. 2 shows the carburetor of FIG. 1 in an arrangement with an air filter and on an internal combustion engine;

FIG. 5 is a view of a further exemplary embodiment of the transmission connection in a view similar to that of FIG. 4; and FIG. 6 is a cross-sectional view taken through that end of the air channel that faces the internal combustion engine and includes a branch element for distributing the fuel-free air for combustion to two transfer ports.

SUMMARY OF THE INVENTION

The diaphragm-type carburetor of the present invention is characterized primarily in that the component secured on the carburetor housing is secured on a longitudinal side of the intake channel portion, in that the component is a functional component of the carburetor, in that the air channel extends approximately parallel to the intake channel portion from that end face of the carburetor that faces an air filter to the connecting side of the carburetor that faces the internal combustion engine, and in that the shaft of the throttle member and the shaft of the butterfly valve are coupled together by means of a transmission connection.

Arranging the air channel in a functional component of the carburetor that is disposed on a longitudinal side of the carburetor housing leads to a compact construction, so that the inventive carburetor can also be used where the space conditions are limited. With the inventive carburetor the shaft of the throttle member and the shaft of the butterfly valve can be coupled together via a straightforward transmission connection in a manner that is dependent upon position, whereby this transmission connection is also provided on the carburetor housing on a longitudinal side of the intake channel portion.

The functional component is expediently embodied as the cover of the compensation chamber, so that in place of the cover otherwise used with diaphragm-type carburetors for the compensation chamber, now the functional component is utilized. Despite the provision of a further component this leads to a small overall size as measured transverse to the intake channel, so that the carburetor is particularly suitable for use in portable, manually guided implements.

The transmission connection is advantageously disposed externally of the carburetor housing and connects one end of the butterfly valve shaft with the adjacent end of the shaft of the throttle member in the air channel. In so doing, the transmission connection is driven by the butterfly valve shaft and is advantageously configured in such a way that the butterfly valve shaft traverses a free play path in the opening direction of the butterfly valve before the shaft of the throttle member in the air channel is taken along. This ensures that during idling and in the lower partial throttle range when the air channel is opened the fuel/air mixture that flows into the combustion chamber is not unintentionally made lean. Only after the butterfly valve has reached a structurally prescribed opening position, in which a greater quantity of fuel/air mixture flows into the crank case of the internal combustion engine, is the throttle member of the air channel opened. The configuration of the free play determines the angular range over which the butterfly valve can be adjusted without actuating the throttle member.

Further specific features of the present invention will be described in detail subsequently.

DESCRIPTION OF PREFERRED EMBODIMENTS

Figure 3:
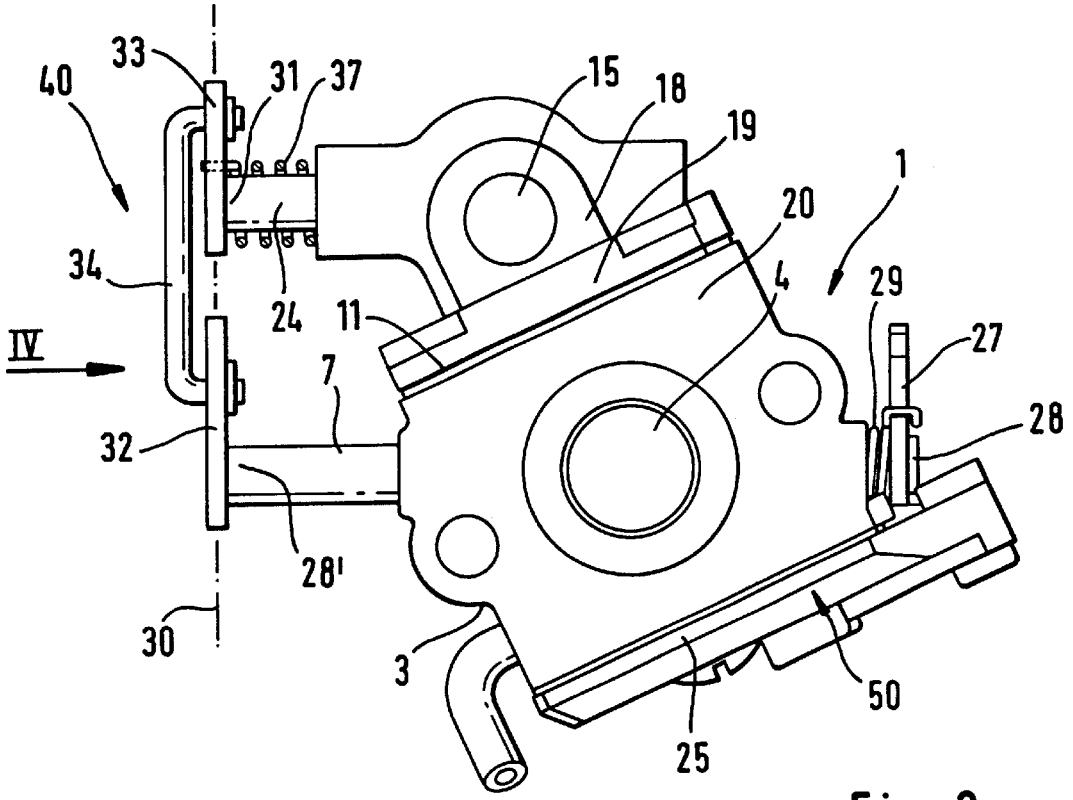
FIG. 3 is a plan view of the end face of the carburetor taken in the direction of the arrow III in FIG. 1.

Referring now to the drawings in detail, the diaphragm-type carburetor 1 illustrated in FIGS. 1–3 serves for supplying fuel-free air for combustion, and a fuel/air mixture, to an internal combustion engine 2. The internal combustion engine is a two-cycle engine that operates with layered scavenging and is preferably used in manually guided implements. Such manually guided, portable implements can be embodied as power chainsaws, cut-off machines, brush cutters, blowers or the like.

The diaphragm-type carburetor essentially comprises a carburetor housing 3 in which is formed a continuous intake channel portion 4 having a Venturi section 5. A throttle or butterfly valve 6 is disposed downstream of the Venturi section 5 in the intake channel portion 4. The butterfly valve 6 is pivotably held via a shaft 7 that is mounted in the carburetor housing 3. A fuel-conveying main channel 8 opens into the Venturi section 5 upstream of the butterfly valve 6. Fuel-conveying idling ducts 9 open into the intake channel portion 4 in the vicinity of the butterfly valve.

The channels and ducts 8, 9 are supplied with fuel from a fuel-filled control chamber 10, which in turn is supplied with fuel from a non-illustrated fuel tank, via a fuel line, by a fuel pump 50 that is driven by the fluctuating crankcase pressure of the two-cycle engine.

The control chamber 10 is formed in the carburetor housing 3 and by means of a control diaphragm 11 is separated from a compensation chamber 12 that is connected by means of a bore 60 with the atmosphere or by means of a channel 70 with the clean air chamber 17 of an air filter 16. The control chamber 10, the control diaphragm 11, and the compensation chamber 12 are provided in the carburetor housing 3 on a longitudinal side 13 of the carburetor housing 3 that is approximately parallel to the intake channel portion 4 (FIG. 1).

In addition to the intake channel portion 4, by means of which a fuel/air mixture is supplied to the internal combustion engine 2, an air channel 15 is provided and has a throttle member 14. The air channel 14 acts as a bypass to the intake channel portion 4 and connects the clean air side of the air filter 16 with non-illustrated transfer ports of the internal combustion engine 2. In the illustrated embodiment, the air channel 15 is disposed approximately parallel to the intake channel portion 4, and is provided in a functional component 18 of the diaphragm-type carburetor 1. The functional component 18 is fixedly connected to the carburetor housing 3 and forms the cover 19 of the compensation chamber 18, whereby the control diaphragm 11 is preferably held in a clamped manner between the carburetor housing 3 and the functional component 18 that is installed as the cover 19.

The air channel 15 extends from that end face 20 of the diaphragm-type carburetor 1 that faces the air filter 16 to the connecting side 21 of the carburetor that faces the internal combustion engine 2. In the illustrated embodiment, an end 22 of the functional component 18 that faces the air filter 16 projects into the air filter housing; similarly, the air channel 15 extends into the clean air chamber 17 of the air filter.

Advantageously, an end 23 of the functional component 18 also extends over the connecting side 21, whereby in the vicinity of the end 23 the air channel 15 is larger than at the end 22 that faces the air filter 16. In the illustrated embodiment, at that end 23 of the functional component 18 that extends beyond the connecting side 21 the air channel 15 has an inner diameter D and by means of a transition portion 124 adjoins a portion of the air channel 15 that leads to the air filter 16 and that has the smaller diameter "d".

Disposed in that portion of the air channel 15 that has the larger diameter D is the throttle member 14, which is in the form of a valve and that is pivotably held by a shaft 24 that is mounted in the functional component 18.

In the illustrated embodiment, the functional component 18 is monolithically embodied with the cover 19 of the compensation chamber 12 and is disposed on the longitudinal side 13 of the carburetor housing 3. In a similar manner, the functional component 18 can also be monolithically embodied with the cover 25 of the fuel pump 50 and can be arranged on the longitudinal side 26 of the carburetor housing 3.

Figure 4:
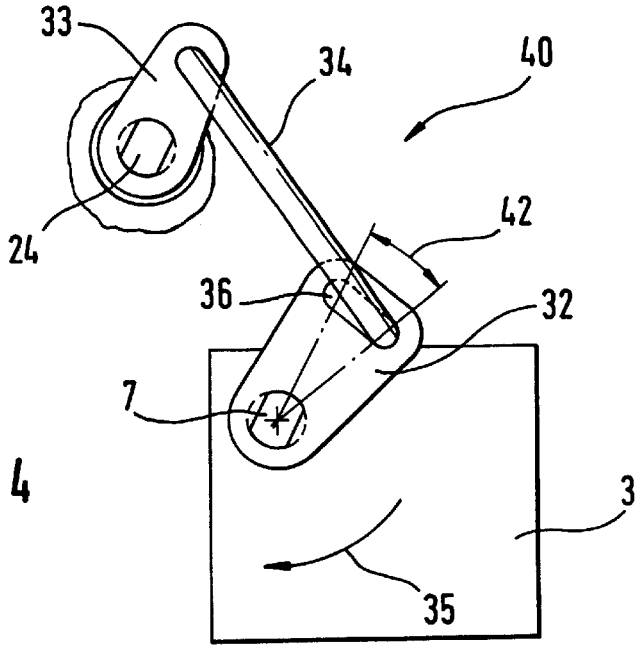
FIG. 4 is a plan view of the transmission connection between the butterfly valve shaft and the shaft of the throttle member taken in the direction of the arrow IV in FIG. 3.

As shown in FIGS. 3–5, in the illustrated embodiment the butterfly valve 7 and the shaft 24 of the throttle member 14 of the air channel 15 are disposed approximately parallel to one another; however, an angular disposition relative to one another can also be expedient.

One end of the butterfly valve shaft 7 carries an actuating lever 27 that is connected in a non-illustrated manner with a gas lever or the like for adjusting the butterfly valve 6. In particular, the actuating lever 27 is fixedly disposed at an end 28 of the butterfly valve shaft 7 and is spring loaded in the closing direction of the butterfly valve 6 by means of a return spring 29.

The other end 28' of the butterfly valve shaft 7 projects out of the carburetor housing 3 and ends at an imaginary plane 30 at which an end 31 of the shaft 24 of the throttle member 14 in the air channel 15 ends. As can be seen in particular in FIGS. 3 and 4, the end 28' fixedly carries a lever 32 while the end 31 of the shaft 24 of the throttle member 14 carries a lever 33. The levers 32, 33 are interconnected by means of a tie-rod 34, one end of which pivotably engages the lever 33 and the other end of which is disposed in an elongated slot 36 in the other lever 32, with this slot extending approximately in the direction of rotation 35. The transmission connection 40 that is thus formed between the shaft 24 of the throttle member 14 and the butterfly valve shaft 7 is driven by the butterfly valve shaft 7, resulting in a coupling of the throttle member 14 with the butterfly valve 6 that is a function of position. The starting position of the butterfly valve shaft 7 and the shaft 24 of the throttle member 14 illustrated in FIG. 4 is in each case determined by springs. The return spring 29 acts upon the butterfly valve shaft 7 in a closing direction of the butterfly valve 6; in a similar manner, a coil spring 37 acts upon the shaft 24 of the throttle member 14 and determines the closing position of the valve-type throttle member 14 in the air channel 15.

In the idle position of the internal combustion engine 2 shown in FIG. 2, the two valves 6, 14 are in the closed position. In this position, the valves 6 and 14 form an angle 38 of about 12° to 18° relative to the longitudinal central axis 39 and 41 of the channels 15 and 4.

Starting from the idle position shown in FIG. 2, the butterfly valve 6 is opened by pivoting the actuating lever 27 in the opening direction 35, so that a greater quantity of fuel-air mixture is conveyed to the internal combustion engine 2. The speed of the internal combustion engine increases. As soon as the butterfly valve 6, i.e. the butterfly valve shaft 7, in the opening direction 35 has passed through a free play extent 42 that is determined by the length of the slot 36, then by means of the tie-rod 34 the lever 33 is also pivoted in the opening direction 35, as a result of which by means of the shaft 24 the valve-type throttle member 14 in the air channel 15 is carried along in the opening direction 35. In additional to the fuel/air mixture, air for combustion by itself, which is expediently collected previously in the transfer ports from the crank case to the combustion chamber, is conveyed to the internal combustion engine via the air channel 15. For this purpose, as shown in FIG. 6, a branch element 43 can be disposed at the end 23 of the functional component 18; the branching air supply channels 44 and 45 of the branch element 43 open into the corresponding transfer ports.

Starting from the illustrated idle position of the butterfly valve 6, during the start of pivoting of the butterfly valve 6, i.e. of the lever 32 that is connected with the butterfly valve shaft 7, in the opening direction 35, the position of the shaft 24 of the throttle member 14 initially remains unchanged due to the free play 42; the throttle member 14 keeps the air channel 15 closed. This ensures that during idling as well as in the lower low-running range of the internal combustion engine, not too much air is supplied, which would result in making the mixture leaner than desired. Only after the butterfly valve 6 in the intake channel portion 4 conveys a greater quantity of fuel/air mixture is the free play 42 traversed, so that during a further movement in opening direction 35 by means of the transmission connection 40 the shaft 24 with the throttle member 14 is also pivoted in the opening direction. In addition to the fuel/air mixture, in the middle partial throttle and full throttle ranges air for combustion by itself is conveyed via the air channel 15 to the transfer ports. The air for combustion is expediently supplied to the intake channel portion 4 and the air channel 15 via a common air filter 16.

In the embodiment of a transmission connection 40 illustrated in FIG. 5, the lengths L1 and L2 of the levers 32' and 33' are such that their free ends 46 and 47 can come into abutment with one another. The facing longitudinal edges of the levers 32' and 33' have a cam contour 48 or 49, the configuration of which effects a constructive coupling of the inter-associated position of the butterfly valve 6 and throttle member 14.

If in the embodiment illustrated in FIG. 5 the butterfly valve shaft 7 with the butterfly valve 6 is moved in the opening direction 35 against the force of the spring 29, then during idling and in the lower low-running range the shaft 24 of the throttle member 14 in the air channel 15 remains unactuated until the free play extent 42 between the free end 47 of the lever 32' and the free end 46 of the lever 33' is overcome. When the cam contour 48 of the free end 47 comes to rest against the cam contour 49 of the free end 46, the butterfly valve 6 in the intake channel 4 is already in a partial throttle position. Upon further opening of the butterfly valve 6, the shaft 24, and hence the throttle member 14, are taken along in the opening direction 35, whereby the regulating path is determined by the cam contour 48 and 49 of the longitudinal edges of the levers 32' and 33'. By means of these cam contours, a desired opening characteristic of the throttle member 14 in the air channel 15 can be structurally described as a function of the position of the throttle valve 6 in the intake channel portion 4 of the carburetor 1.

The specification incorporates by reference the disclosure of German priority document 199 18 719.3 of Apr. 24, 1999.

The present invention is, of course, in no way restricted to the specific disclosure of the specification and drawings, but also encompasses any modifications within the scope of the appended claims.

What I claim is:

1. A diaphragm carburetor for an internal combustion engine that operates with layered scavenging, comprising:

a carburetor housing in which are provided an intake channel portion, a fuel-filled control chamber that is formed on a longitudinal side of said intake channel portion in said carburetor housing, and a compensation chamber that is separated from said control chamber via a control diaphragm;

a first shaft mounted in said intake channel portion;

a butterfly valve that is pivotably disposed on said first shaft, wherein fuel-conveying channels that are supplied from said control chamber open into said intake channel portion in the vicinity of said butterfly valve;

a functional component for said carburetor secured on said carburetor housing on said longitudinal side of said intake channel portion, wherein an air channel for conveying air for combustion is provided in said functional component;

an air filter disposed on a first side of said carburetor, wherein said air channel extends approximately parallel to said intake channel portion from said first side of said carburetor to a connecting side of said carburetor that faces said internal combustion engine;

a second shaft mounted in said air channel;

a throttle member that is rotatably disposed on said second shaft; and a transmission connection coupling together said second shaft of said throttle member and said first shaft of said butterfly valve.

2. A diaphragm carburetor according to claim 1, wherein said functional component is a cover for said compensation chamber.

3. A diaphragm carburetor according to claim 1, wherein said control diaphragm is held clamped in between said carburetor housing and said functional component.

4. A diaphragm carburetor according to claim 1, wherein said transmission connection operatively connects one end of said butterfly valve shaft with an adjacent end of said shaft of said throttle member.

5. A diaphragm carburetor according to claim 4, wherein said transmission connection is driven by said butterfly valve shaft.

6. A diaphragm carburetor according to claim 4, wherein said butterfly valve shaft, starting from an idle position, in an opening direction of said butterfly valve traverses a free play during which a position of said shaft of said throttle member remains unchanged.

7. A diaphragm carburetor according to claim 1, wherein said transmission connection is a lever connection.

8. A diaphragm carburetor according to claim 7, wherein said lever connection comprises respective levers fixedly mounted on ends of said first and second shafts, wherein said levers cooperate with one another in a torque-transferring manner.

9. A diaphragm carburetor according to claim 8, wherein said levers are interconnected by a rod that is pivotably connected with the lever of said second shaft and engages in a slot of the other lever, with said slot extending in a direction of rotation of said other lever.

10. A diaphragm carburetor according to claim 8, wherein said levers are provided with cam contours that can register with one another.

11. A diaphragm carburetor according to claim 1, wherein said air filter is common to both said intake channel portion and said air channel for supplying air for combustion thereto.

12. A diaphragm carburetor according to claim 11, wherein an end of said air channel that faces said air filter projects into a housing of said air filter.

* * * * *